US007316279B2

(12) United States Patent
Wiseman et al.

(10) Patent No.: US 7,316,279 B2
(45) Date of Patent: Jan. 8, 2008

(54) POLYCRYSTALLINE CUTTER WITH MULTIPLE CUTTING EDGES

(75) Inventors: Henry Wiseman, Lancaster, OH (US); Tom Easley, Bexley, OH (US); Scott Arlen Ries, Grove City, OH (US)

(73) Assignee: Diamond Innovations, Inc., Worthington, OH (US)

( * ) Notice: Subject to any disclaimer, the term of this patent is extended or adjusted under 35 U.S.C. 154(b) by 200 days.

(21) Appl. No.: 11/262,342

(22) Filed: Oct. 28, 2005

(65) Prior Publication Data

US 2006/0102389 A1 May 18, 2006

Related U.S. Application Data

(60) Provisional application No. 60/623,120, filed on Oct. 28, 2004.

(51) Int. Cl.
*E21B 10/46* (2006.01)

(52) U.S. Cl. ..... 175/57; 175/428; 175/432

(58) Field of Classification Search ..... 175/428, 175/432, 434, 57
See application file for complete search history.

(56) References Cited

U.S. PATENT DOCUMENTS

| | | | | |
|---|---|---|---|---|
| 3,388,757 | A | 6/1968 | Fittinger | |
| 4,512,426 | A | 4/1985 | Bidegaray | |
| 4,545,441 | A | 10/1985 | Williamson | |
| 4,552,232 | A | 11/1985 | Frear | |
| 5,007,493 | A * | 4/1991 | Coolidge et al. | 175/432 |
| 5,145,017 | A | 9/1992 | Holster et al. | |
| 5,279,375 | A | 1/1994 | Tibbitts et al. | |
| 5,437,343 | A | 8/1995 | Cooley et al. | |
| 5,667,028 | A | 9/1997 | Truax et al. | |
| 5,778,994 | A | 7/1998 | Spatz | |
| 5,848,657 | A | 12/1998 | Flood et al. | |
| 5,944,129 | A | 8/1999 | Jensen | |
| 5,979,578 | A * | 11/1999 | Packer | 175/432 |
| 5,996,713 | A | 12/1999 | Pessier et al. | |
| 6,050,354 | A | 4/2000 | Pessier et al. | |
| 6,068,071 | A * | 5/2000 | Jurewicz | 175/432 |
| 6,164,394 | A | 12/2000 | Mensa-Wilmot et al. | |
| 6,167,975 | B1 | 1/2001 | Estes | |
| 6,196,340 | B1 * | 3/2001 | Jensen et al. | 175/431 |
| 6,241,035 | B1 | 6/2001 | Portwood | |
| 6,272,753 | B2 | 8/2001 | Packer | |
| 6,315,652 | B1 | 11/2001 | Snyder et al. | |
| 6,394,199 | B1 | 5/2002 | Skyles et al. | |
| 6,443,248 | B2 | 9/2002 | Yong et al. | |
| 6,527,069 | B1 | 3/2003 | Meiners et al. | |
| 6,739,417 | B2 * | 5/2004 | Smith et al. | 175/432 |

(Continued)

FOREIGN PATENT DOCUMENTS

| | | |
|---|---|---|
| EP | 0117506 | 9/1984 |

(Continued)

*Primary Examiner*—William P Neuder
(74) *Attorney, Agent, or Firm*—Pepper Hamilton LLP

(57) ABSTRACT

A cutting element includes a layer of integrally bonded superabrasive particles disposed over a substrate. The layer has an outer circumference comprising at least one trough having a distinct cutting point on either side of the trough. A rock drilling drag bit incorporating the cutting element and a method of cutting a material using the cutting element are also disclosed.

18 Claims, 6 Drawing Sheets

U.S. PATENT DOCUMENTS

| | | | | |
|---|---|---|---|---|
| 2001/0003932 | A1 | 6/2001 | Packer | |
| 2002/0108791 | A1 | 8/2002 | Eyre et al. | |
| 2003/0116361 | A1* | 6/2003 | Smith et al. | 175/428 |
| 2003/0150649 | A1 | 8/2003 | Sved | |
| 2003/0150650 | A1 | 8/2003 | Sved | |
| 2003/0150651 | A1 | 8/2003 | Sved | |
| 2003/0150652 | A1 | 8/2003 | Sved | |
| 2004/0103757 | A1 | 6/2004 | Scott | |
| 2005/0269139 | A1* | 12/2005 | Shen et al. | 175/430 |

FOREIGN PATENT DOCUMENTS

| | | | |
|---|---|---|---|
| EP | 0117552 | | 9/1984 |
| EP | 0189212 | | 7/1986 |
| EP | 0236924 | | 9/1987 |
| EP | 0542237 | A1 | 5/1993 |
| EP | 0852283 | | 7/1998 |
| EP | 0918135 | | 5/1999 |
| GB | 2344607 | | 6/2000 |
| GB | 2373522 | | 9/2002 |
| GB | 2378202 | | 2/2003 |
| GB | 2378721 | | 2/2003 |
| WO | WO 97/08420 | | 3/1997 |
| WO | WO 97/35091 | | 9/1997 |

* cited by examiner

POLYCRYSTALLINE CUTTER WITH MULTIPLE CUTTING EDGES

RELATED APPLICATION AND CLAIM OF PRIORITY

This application claims the benefit and priority of U.S. Provisional Application No. 60/623,120, filed Oct. 28, 2004, which is incorporated herein by reference in its entirety.

BACKGROUND

The present disclosure relates to superabrasive cutters with multiple cutting edges. Specifically, superabrasive cutters for rock drilling drag bits are described having two or more cutting points or edges that are formed into the outer periphery of the cutter.

Diamonds and cubic boron nitride ("CBN") have been widely used as superabrasives on saws, drills, and other tools that utilize the superabrasive to cut, form, or polish other hard materials. Polycrystalline diamond ("PCD") cutting elements are generally known. A PCD compact is a mass of diamond particles, bonded together to form an integral, tough, high-strength mass. Diamond or CBN particles may be bonded together as a compact in a particle-to-particle self-bonded relationship, optionally with a bonding medium disposed between the particles, such as a catalyzing material used to bond the abrasive particles together. For example, U.S. Pat. Nos. 3,236,615; 3,141,746; and 3,233,988, the disclosures of each of which are herein incorporated by reference in their entirety, describe PCD compacts and methods of forming the same.

An abrasive particle compact may be bonded to a substrate material, such as cemented tungsten carbide. Compacts of this type, bonded to a substrate are sometimes referred to as composite compacts, such as the compacts described in U.S. Pat. Nos. 3,743,489; 3,745,623; and 3,767,371, the disclosures of each of which are herein incorporated by reference in their entirety.

Composite compacts have found special utility as cutting elements in drill bits. Drill bits for use in rock drilling, machining of wear resistant materials, and other operations which require high abrasion resistance or wear resistance generally consist of a plurality of polycrystalline abrasive cutting elements fixed in a holder. For example, U.S. Pat. Nos. 4,109,737 and 5,374,854, the disclosures of each of which are herein incorporated by reference in their entirety, describe drill bits with a tungsten carbide substrate having a polycrystalline diamond compact on the outer surface of the cutting element.

A plurality of cutting elements may be mounted generally by interference fit or otherwise into recesses into the crown of a bit, such as a rotary drill bit. PCD is used as an abrasive wear and impact resistant surface in drilling, mining, and woodworking applications. PCD compacts have been designed to provide to both abrasion resistance and impact strength.

In addition, U.S. Pat. Nos. 5,848,657 and 6,196,340, the disclosures of each of which are incorporated herein by reference, describe dome cutters for roller cone bits. The cutters have a cone, dome, or hemispheric surface shape having grooves or ridges on the cutter surface formed on or about an otherwise non-planar shape. Such cutters are designed for rolling or spinning into a workpiece. In contrast, drag bits remove material by shearing the material and have contact at a single point, mostly at an edge of a planar cutter surface of the drag bit, rather than on the cutter surface itself. Therefore, grooves or ridges on the cutter surface of a drag bit would not be beneficial in cutting material.

Currently, the majority of PCD cutters are cylindrical in shape and have a cutting surface or diamond table or diamond layer that contacts the material to be cut. The PCD cutter generally has a diameter in the sizes of 13 mm, 16 mm, and 19 mm. Non-cylindrical cutters with sharp cutting points, known as scribe cutters, also have been described. In rock drilling drag bits 10, as shown in FIGS. 1A and 1B, either a cylindrical or a scribe cutter 11 may contact the rock 12 initially at a single point 13 and over a continuous surface area 14 as the cutter 11 wears in. The cutter 11 is thus "dragged" over the surface 14 of the material 12 to be cut and contacts the material at a point 13 that, as shown in FIG. 1B, grows into a wear plane 15 during use. As the cutter 11 wears, it forms a flat area 15 that becomes wider, but it still is initially a single point 13 of contact on the front of the diamond table.

Drag bits are constructed comprising various cutter sizes. Performance enhancements (rate of penetration and overall drilling depth) are sought by selecting PCD cutters with improvements in abrasion and/or impact performance among the sizes and shapes described above, and arranging them according to various bit design strategies.

The cost effectiveness of rock drilling drag bits incorporating PCD cutters may be determined by the bit's Rate of Penetration (ROP), which may be measured as a depth drilled over elapsed time (such as feet or meters per hour of operation) and lifetime of the PCD cutters and other bit components. Cutter lifetime is a function of the (1) abrasion resistance and (2) impact strength of the polycrystalline diamond material, in addition to the overall stability of the drill bit. Past efforts have demonstrated that increases in abrasion resistance are normally accompanied by decreases in impact strength. Consequently, reductions in cost effectiveness due to improved cutter materials have proven difficult to achieve. Therefore, many recent efforts have focused on improvements in drag bit design rather than on improved cutter design.

For example, U.S. Pat. No. 6,564,886, describes a bit design incorporating an arrangement of cutters with alternating positive and negative back rake angles; U.S. Pat. No. 5,551,522, describes a bit design incorporating an arrangement of cutters with different exposure height of various cutters; U.S. Pat. No. 5,582,261, describes a bit design incorporating an arrangement of cutters such that some cutters have greater initial exposure to the rock; U.S. Pat. No. 5,549,171, herein incorporated by reference in its entirety, describes a bit design incorporating the use of different back rake angles and scribe cutters; U.S. Pat. No. 5,383,527, describes a cutter design with an asymmetric support and an ovular; U.S. Pat. No. 5,607,024, describes a bit design incorporating cutters that contain areas with differing abrasion resistance, such as different grain sized PCD; and U.S. Pat. No. 5,607,025, describes a bit design incorporating overlapping large and small cylindrical PCD cutters. The disclosures of each of the forgoing references are incorporated herein by reference.

In the prior art, however, the problem of rate of penetration and bit stability are addressed by bit design, rather than cutter design. The bit designs incorporated multiple cutters into a drag bit design. Therefore, it is desirable to provide a cutter design resulting in increased cutter lifetime, rate of penetration, and drill bit stability without changing the material properties of the polycrystalline diamond material. A cutter design that accomplishes these goals through the design of the cutter itself, rather than through the design of a complex bit, is preferred. Such a cutter with improved rate of penetration, lifetime, and strength properties may be incorporated into any number of drill bit designs.

This application describes solutions for one or more of the problems described above.

SUMMARY

In an embodiment, a cutting element comprises a layer of integrally bonded superabrasive particles disposed over a substrate. The layer may have an outer circumference comprising at least one trough having a distinct cutting point on either side of the trough. The superabrasive particles may comprise diamond or cubic boron nitride, and the substrate may comprise a Group IVB, Group VB, or Group VIB metal carbide. The trough may be machined into the layer by electric discharge machining (EDM). The substrate may be cylindrical in shape, may have an outer circumference in which at least one trough can be formed, and may have a substantially planar top surface.

In an embodiment, the layer may have two or more troughs comprising a tooth or teeth, having a distinct cutting edge, between the troughs. In some embodiments, the teeth may be about 0.07 inches high, about 0.05 inches wide, and may have a spacing of about 0.1 inch. In another embodiment, the cutting element comprises two teeth that may be spaced about 0.1 inches apart on one side of the layer and two teeth that may be spaced about 0.1 inches apart on an opposite side of the layer. Other sizes are possible. In yet another embodiment, the trough comprises a non-zero angle relative to a central axis of the cutting element.

The cutting element may be incorporated into a rock drilling drag bit for further use of the drag bit in a cutting material. The cutting element may initially contact a surface of rock or mineral material such as granite, sandstone, limestone, shale, or another material, and it may be dragged along the surface of the material to perform the cutting. The cutting elements may be dragged across the material at an angle, such as an angle of about 5° to about 30°, wherein the angle may be formed between a central axis of the cutting element and the surface of the material. The cutting element may contact the material at or near the center of a tooth with a first one or more cutting points. Additional cutting points may contact the material after the first cutting points have undergone abrasive wear.

BRIEF DESCRIPTION OF THE DRAWINGS

The accompanying drawings, which are incorporated in and form a part of the specification, illustrate various embodiments and, together with the description, serve to explain the principles of the various embodiments.

DETAILED DESCRIPTION

Before the present embodiments, methods, and materials are described, it is to be understood that this disclosure is not limited to the particular embodiments, methodologies, and materials described, as these may vary. It is also to be understood that the terminology used in the description is for the purpose of describing the particular embodiments only, and is not intended to limit the scope.

It must also be noted that as used herein and in the appended claims, the singular forms "a," "an," and "the" include plural references unless the context clearly dictates otherwise. Unless defined otherwise herein, all technical and scientific terms used herein have the same meanings as commonly understood by one of ordinary skill in the art. All publications mentioned herein are incorporated by reference. Nothing herein is to be construed as an admission that the embodiments disclosed herein are not entitled to antedate such disclosure by virtue of prior invention.

In one embodiment, a drag-type drill bit incorporates a superabrasive material (i.e., a material having a Vickers hardness of about 3000 kg/mm$^2$ or greater, such as, diamond or CBN) by providing each cutter with multiple cutting points or edges. Superabrasive cutters may be produced to incorporate two or more cutting edges into the outer circumference of the superabrasive layer. The two or more cutting edges may be formed into the outer circumference by any machining method, as known in the art. If a trough or rounded recession is machined into a superabrasive layer, two or more cutting edges may be formed into the outer circumference of the superabrasive layer, one on either side of the trough. A tooth may thus be formed in between two troughs. The teeth may be flattened elongated triangular ridges that protrude from the outer circumference of the layer. The teeth may also be rounded, sharp, serrated, or of some other desired shape. The troughs may be formed into the periphery or edge of a traditional superabrasive cutter. Troughs may extend along the entire side of the superabrasive cutter, or the trough may partially extend along the height of the cutter, or the trough may extend fully or partially down the abrasive layer of the cutter. A simple embodiment of the cutter may include a single trough in a superabrasive cutter, with each side of the trough being a distinct cutting point.

Additional troughs, such as two, three, four, or more troughs, may be added to form additional cutting edges. These troughs may be formed integrally in the cutter during manufacturing, or by machining them into the side of a cutter (as by electrical discharge machining or grinding), or by some other method. Superabrasive cutting elements described herein have two or more cutting edges, in contrast to the prior art of cylindrical, scribe, or various other shaped cutters in which there is a single cutting point.

Figure 1A:
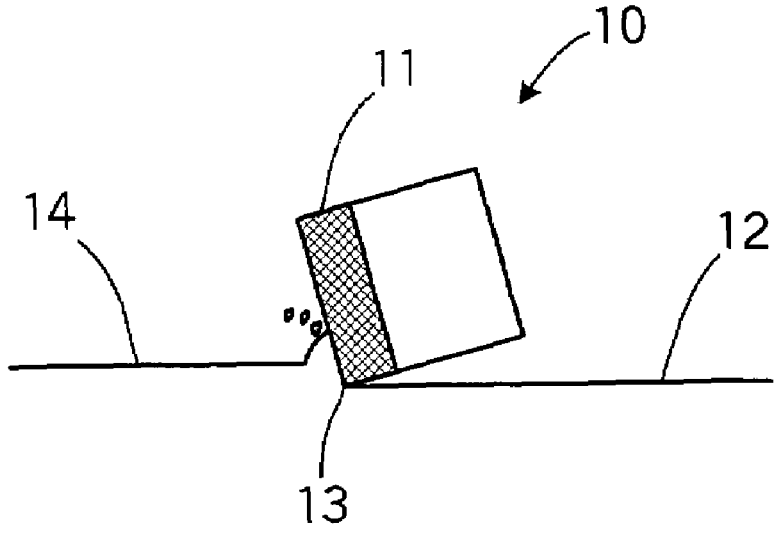
FIG. 1 is an illustration showing a rock drilling drag bit contacting a material.
Figure 1B:
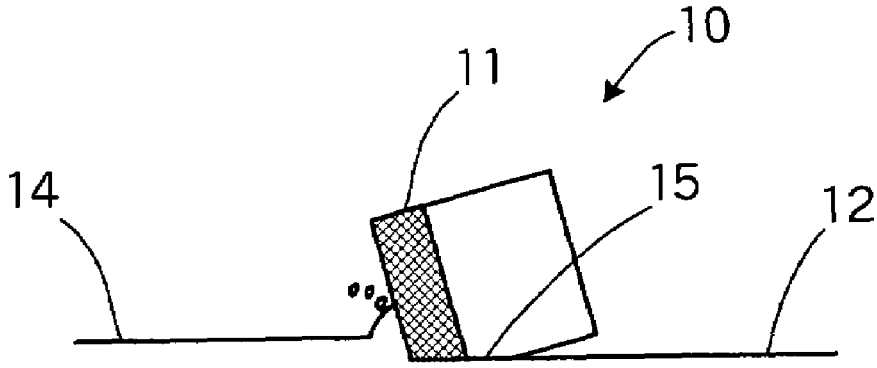
Figure 2:
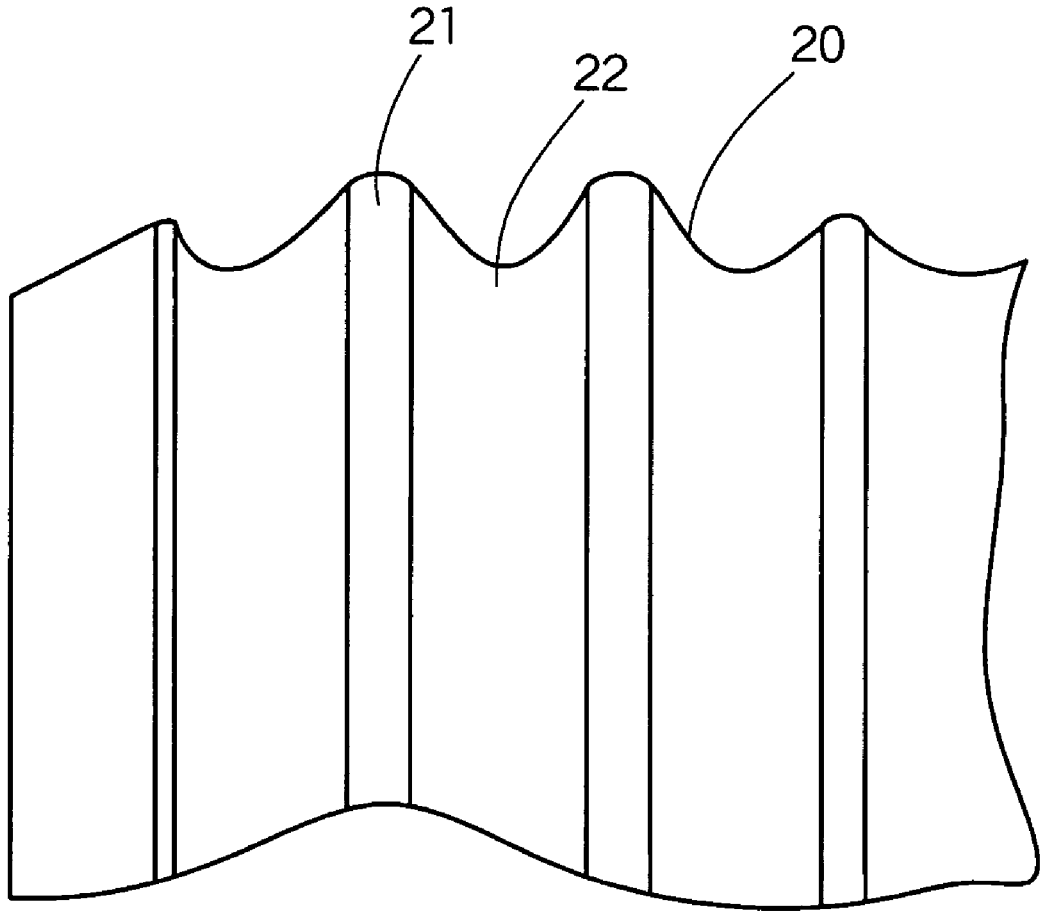
FIG. 2 is an illustration of a side view of a cutting element according to one embodiment.

The one or more troughs may run along the outer circumference of the superabrasive layer parallel to a central axis of the layer. The troughs are elongated recesses formed into the outer circumference of the layer, such that on either side of the trough, there is one cutting point. Therefore, any superabrasive layer having at least one trough on its outer circumference has a plurality of cutting edges. In other embodiments, the troughs may be formed such that they are not parallel to the center axis of the cutter. One example is illustrated in FIG. 2, wherein the troughs 22 may be formed into the outer circumference of the superabrasive layer 23 at an inwardly sloping angle. With troughs 22 that are inwardly cut or formed into the outer circumference of the superabrasive layer 23, the cutter 20 will have a plurality of cutting edges 25. Of course, non-cylindrical cutters may be possible. The troughs 22 are at a non-zero angle to the cutter 20 central axis in which the troughs 22 extend only part way down the outside surface of the cutter 20. The troughs 22 may be formed into the layer 23 such they are non-parallel to the central axis of the cutter 20, while still providing a distinct cutting point 28 on either side of the trough 22. The angle of the troughs 22 may from be about 0° to about 90°, preferably about 15° to about 45° as relative to the central axis of the superabrasive cutter 20. Therefore, if more than one tooth 21 is present in such embodiments, the teeth 21 may be of different sizes and shapes. The two outer most teeth 21*a* have a different shape than the two inner teeth 21*b*. The five troughs 22 between the four teeth 21 illustrated in FIG. 2 may be formed by electro-discharge machining ("EDM") or another suitable process. The troughs 22 may be at different angles of cut and depth of cut, resulting in the different shaped teeth.

In the cutting element embodiments, the substrate may comprise metal carbide comprising a Group IVB, Group VB, and/or Group VIB metal. These groups comprise metals such as titanium, zirconium, vanadium, niobium, chromium and molybdenum. Other materials are possible. In one embodiment, the substrate may be substantially cylindrical in shape, the substrate may have an outer circumference, and the outer circumference may have at least one trough formed into the outer circumference of the substrate. Therefore, the troughs of the superabrasive layer may substantially correspond to the troughs of the substrate, creating elongated recessions into the layer and substrate, and therefore multiple cutting points or edges. Other shapes are possible.

Manufacturing of superabrasive compacts and composite compacts comprising both a superabrasive layer and a substrate are generally known. For example, U.S. Pat. Nos. 3,743,489; 3,745,623; and 3,767,371, the disclosures of each of which are incorporated herein by reference, describe PCD compacts and their formation. Fabrication of a composite compact may be achieved by placing a cemented carbide substrate into a container of a press. A mixture of diamond grains or diamond grains and a catalyst binder may be placed atop the substrate and compressed under high pressure/high temperature (HP/HT) conditions. The requisite catalytic binders may comprise cobalt, iron, nickel (iron group metals), or mixtures thereof. These conditions include a pressure of between about 25 kbars and about 75 kbars, and a temperature of about 1000° C. or higher. In so doing, the metal binder migrates from the substrate and sweeps through the diamond grains to promote a sintering of the diamond grains. As a result, the diamond grains become bonded to each other and form a diamond layer, which concomitantly is bonded to the substrate along the interface. In placing the diamond grains and optional catalyst binder atop the substrate in a press, there may be used a suitable cast or mold placed around the diamond grains to form a layer of PCD in a suitable design. For example, a cast or mold may include one or more teeth to be integrally formed into the outer surface of the PCD layer. Other sizes are possible.

Cutting elements of the embodiments described herein may have any number of teeth, and may have teeth spaced around the outer circumference optionally in equidistance, although equidistance is not required. In one embodiment, there are several teeth on the outer circumference, such as if at 3 o'clock. In another embodiment, there are two or more sets of the several teeth on the outer circumference, such as if at 3 o'clock and 9 o'clock. A cutter would have such multiple sets of teeth so that it may be rotated within the bit and re-used if desired. In another embodiment, the cutting elements may have teeth formed into the outer circumference that are about 0.07 inches high by about 0.05 inches wide and that are spaced about 0.1 inches apart from each other. Other sizes are possible.

In one embodiment, the cutting element comprises a superabrasive layer that may have at least one trough that is machined into the outer circumference of the layer by EDM. In this process, a wire electrode may be brought into close contact with the cutter, causing sparks to form. These sparks burn through the material with which it is in contact and the wire continues to move through the cutter, removing material by spark erosion. The wire movement may be controlled by a computer numerical control or may utilize a computer programmed to follow any desired path. The wire may contact the material parallel to the cutter axis such that the troughs extend the entire length of the cutter, or the wire may contact the material at a non-zero angle in the range of about 0° to about 90° to the cutter axis such that the troughs extend only part way down the side of the cutter.

In another embodiment, the one or more troughs may be formed integrally with the superabrasive layer. A molding may be used having desired trough and/or tooth spacing, shape, depth, and width requirements. Such a mold may essentially correspond to the shape of the cutouts. The mold may be formed of tungsten carbide or other suitable material, and may be in the shape of a partial or full ring to which the molding-teeth are attached. This molding ring may be placed in the bottom of a refractory metal cup, and diamond grains may be added to the cup. A tungsten carbide substrate may then be placed in the cup, on top of the diamond grains, forming the cup assembly. The cup assembly may then be placed in a pressure cell and processed using the usual methods for making superabrasive cutters. The resulting article would comprise a substrate topped by a polycrystalline diamond table containing the tungsten carbide molding. The diamond having formed between the individual moldings form the multiple cutting points in the outer circumference of the cutter. The tungsten carbide moldings may be removed by any of several methods, including blasting with abrasive grit such as one including silicon carbide (SiC) or dissolving them in a strong acid, which will attack the tungsten carbide but not the polycrystalline diamond. Alternatively, the tungsten carbide moldings may be left in the cutter. The moldings have a lower abrasion resistance, which may cause them to wear away during use.

In another embodiment, the cutting elements may be incorporated into any number of bit designs, including rock drilling drag bits. Such bit designs may include any of the bit designs described in the background section. The cutting elements comprise a substantially planar cutting surface and an outer circumference having at least one trough and may have a plurality of troughs that create multiple cutting points. The drag bits use the cutting elements to remove material by shearing the rock and have contact at a single line on a leading edge of the cutter. The cutters are thus dragged over the surface of the material to be cut and have contact at a point that grows into a wear plane during use. The troughs on the outer circumference are positioned such that they interrupt the usual contact zone. Thus, after wearing in, new cutting points are introduced due to the presence of the troughs. The new cutting points also introduce increased cutting stress, since the contact area is smaller. Therefore, due to the location of the troughs on the outer circumference of the cutting element and its planar-shaped cutting surface, the rate of penetration of the cutting element and the stability of the drill bit are increased.

Figure 3:
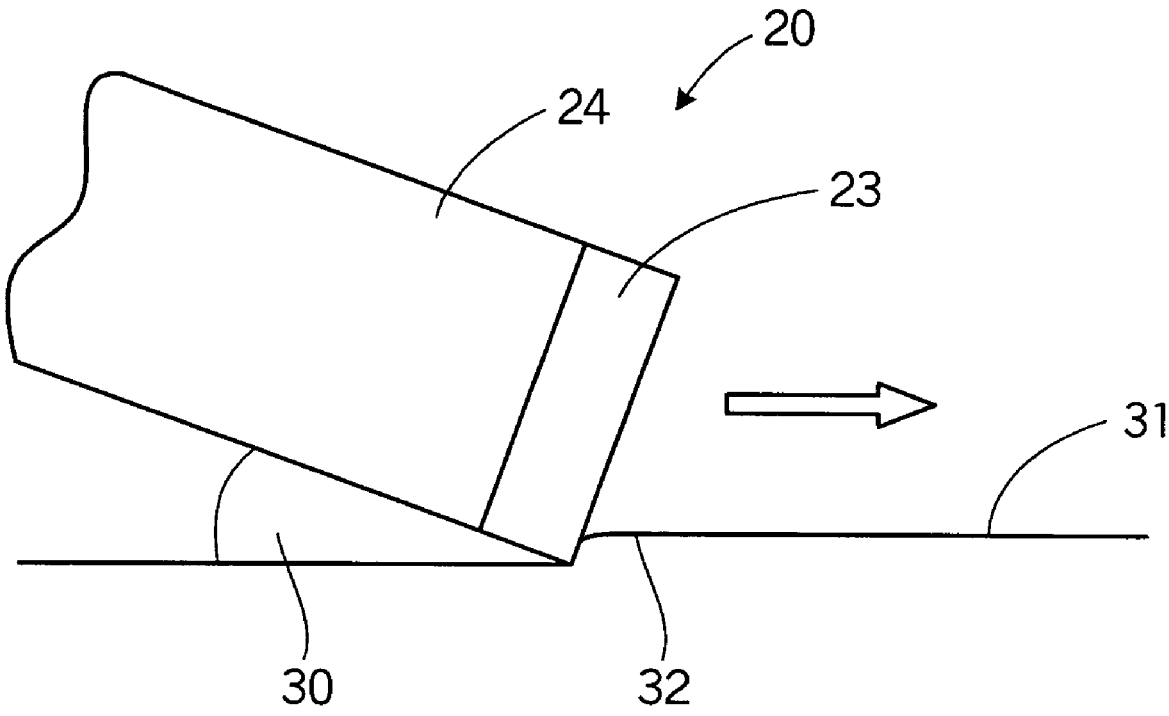
FIG. 3 shows a cutting element contacting a material and the relative motion of the cutting element.

In another embodiment, as shown in FIG. 3, a method of cutting a material is provided. The method includes contacting a cutting element 20 to the surface of a material. The superabrasive cutter may be dragged across the surface of the material to perform cutting.

In the method embodiments, the cutting element 20 may contact the material 32 and it may be dragged or pushed across the material 32 at an angle 30 of about 5° to about 30°, wherein a central axis 33 of the cutting element 20 and the surface 31 of the material 32 define the angle 30. This angle 30, which is an angle formed between a primary axis of the cutter and the surface of the material being cut, taken in a plane that is normal to the point of contact, is sometimes termed a "back rake" angle in the art of drill bits and drilling applications. The back rake angle 30 may be customized or adjusted according to different cutting applications and/or the location of the cutter 20 in the bit. In addition, the material 32 to be cut may be a rock or mineral, such as limestone, sandstone, shale, granite, or any other geologic formation to be drilled. The cutting element may contact the material at or near the center of a tooth with a first one or more cutting points. Additional cutting points may contact the material after the first cutting points have undergone abrasive wear.

Figure 4:
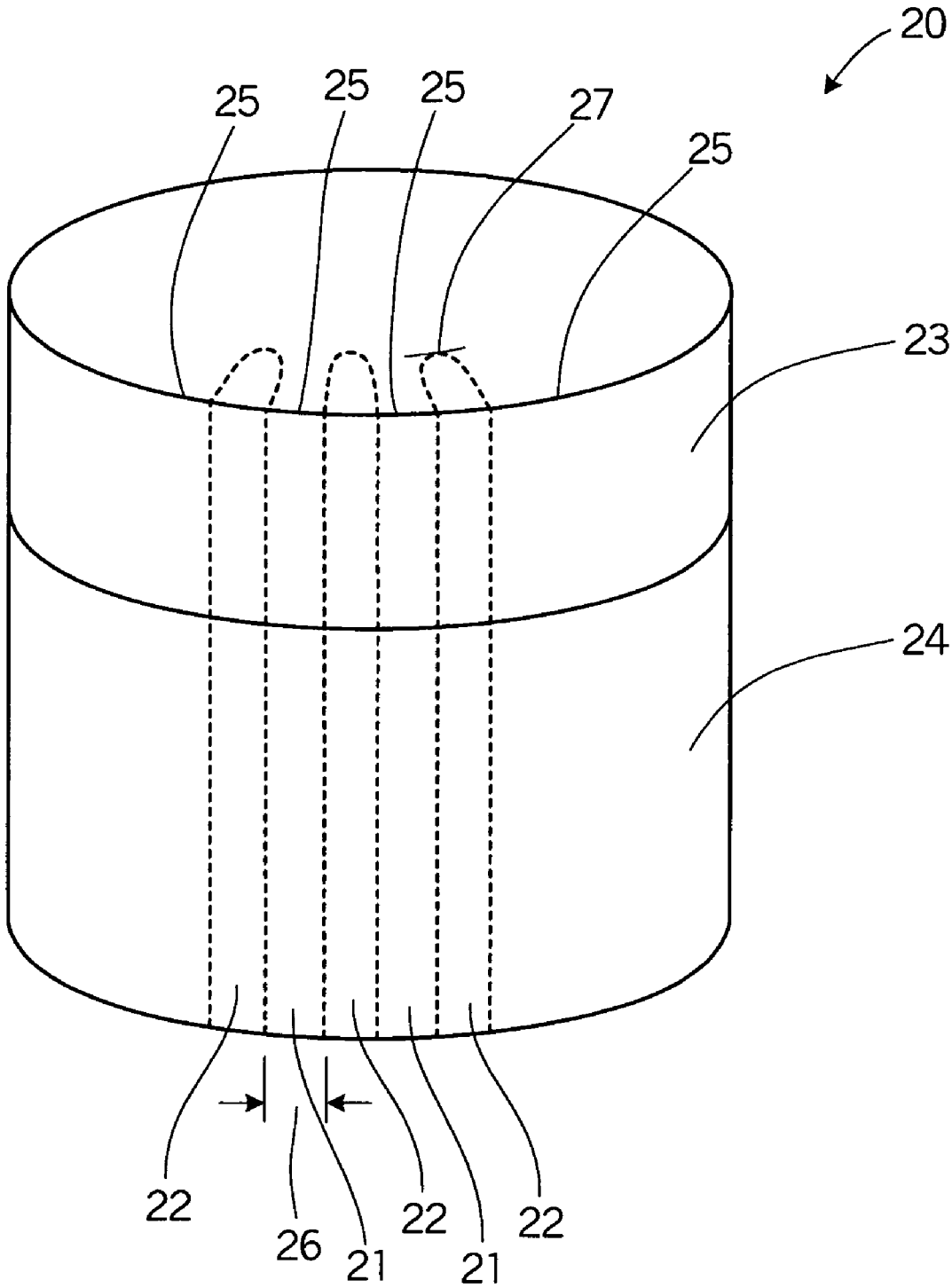
FIG. 4 is a view of a cutting element according to one embodiment.

One example of a cutter 20, with two teeth 21, is shown in FIG. 4 (side view). FIG. 4 illustrates how troughs 22 may be cut into a cutter 20 having a superabrasive layer 23 and a substrate 24. The dotted lines represent material removed by machining, such as EDM wire cutting. Therefore, two teeth 21, and four distinct cutting points or edges 25 may be formed into the outer circumference of the cutter 20. In this example, the cutout material or troughs 22, as represented by the dotted lines, may be semi-circular. Cutouts 22 may also be curved, square, triangular, or other suitable shape. The tooth dimensions are also visible in FIG. 4, wherein the width 26 of the tooth 25 equals the space 21 between cutouts 22. The spacing 21 is the width of the material cutout 22 of the cutter 20. The tooth depth 27 is the distance radially cut into the cutter 20.

In another example, there may be eight teeth per cutter. The teeth may be arranged such that there are four teeth on one side of the cutter and four teeth on the other side, as if at 3 o'clock and 9 o'clock on the outer circumference. Therefore, the life of the cutter may be extended in that once the cutter is worn on one side, it may be rotated and used on the opposite side. In one embodiment, the teeth may have a height of about 0.07", a width of about 0.05", and a spacing of about 0.1". The heights of the teeth correspond to the depth of the trough or cutout that created the tooth as explained in FIG. 4. The troughs may be etched or machined or formed into the outer circumference by wire electric discharge machining.

The teeth may be spaced and separated by a trough or a rounded cut into the outer surface of the superabrasive layer. It may be possible to machine or cut out two troughs or rounded recessions thus creating a tooth formed between the two troughs. FIG. 4 also illustrates that the troughs 22 may be formed into the outer surface of the substrate 24, resulting in elongated troughs 22 extending the entire height of the superabrasive cutter 20.

Figure 5:
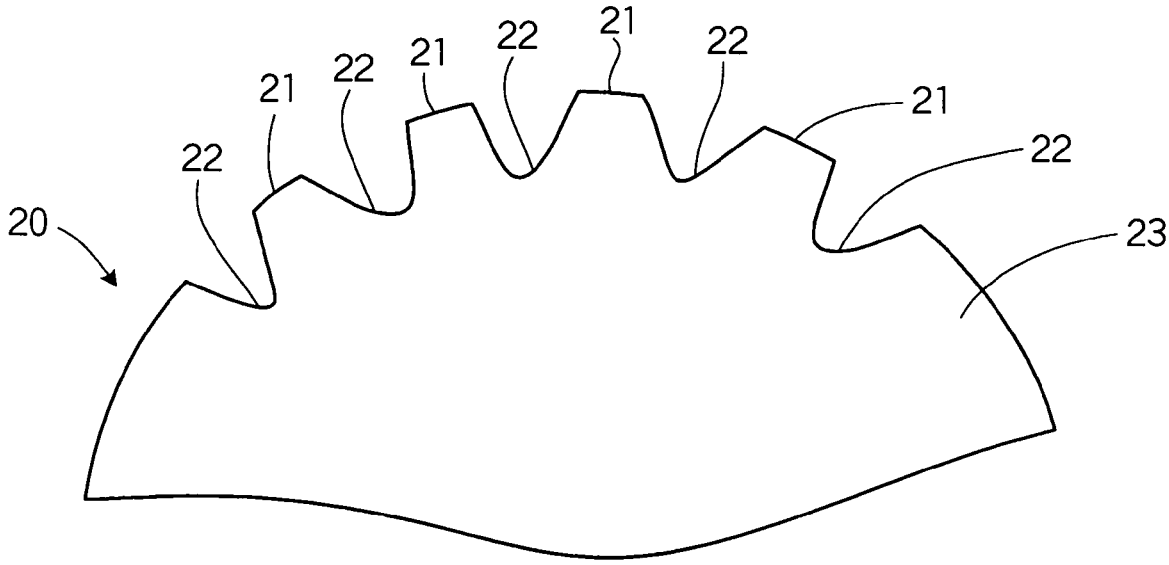
FIG. 5 is a top view of a cutting element according to one embodiment.
Figure 6:
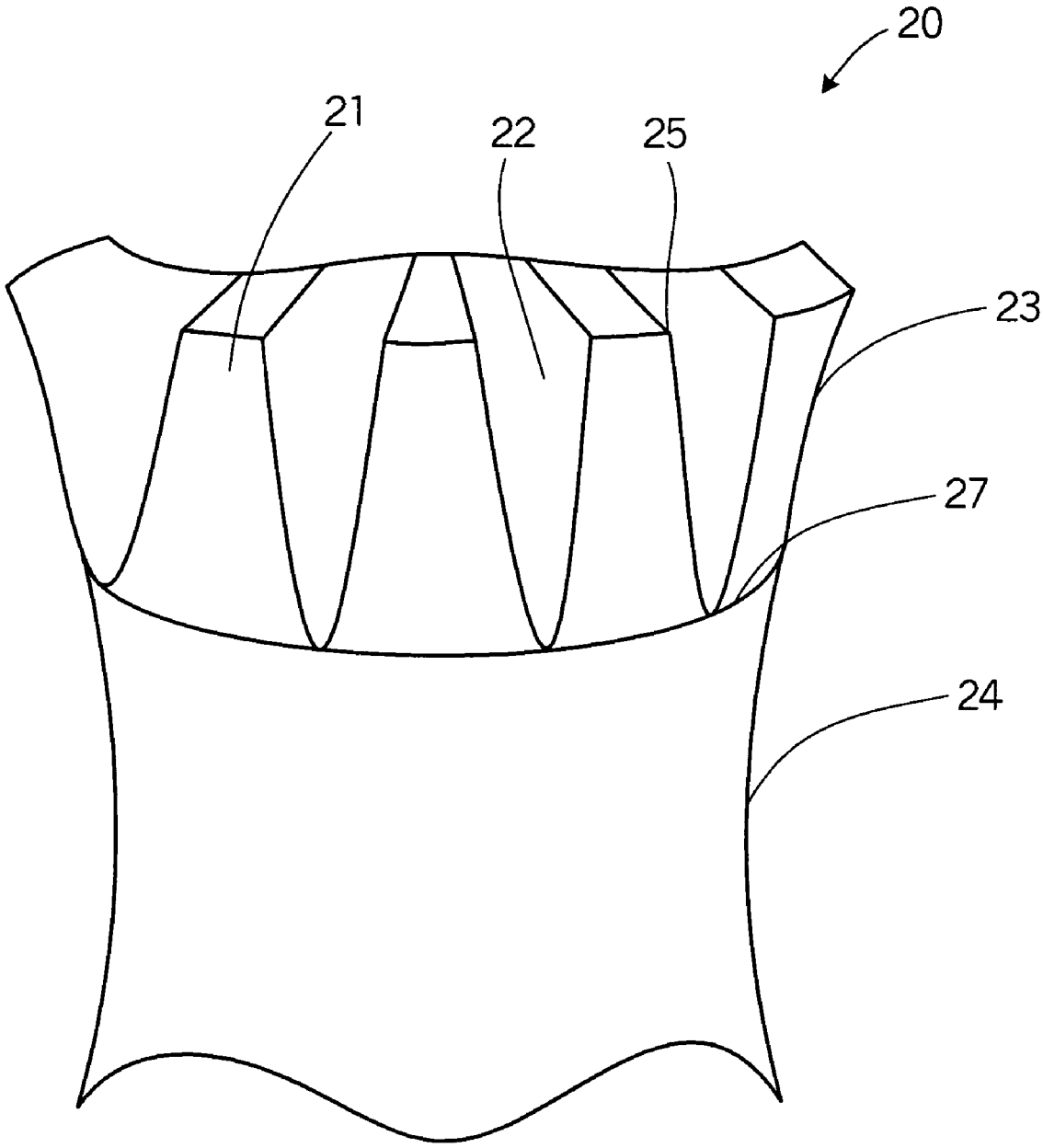
FIG. 6 is a side view of a cutting element according to one embodiment.

FIG. 5 shows an exemplary tooth shape. FIG. 6 shows an example in which the tooth shape does not extend completely into the cutter substrate. Other sizes and/or shapes of cutting teeth may be provided, although FIGS. 5 and 6 show that the teeth 21 are triangular raised edges extending from the superabrasive layer 23. FIG. 5 is a top view of a cutter 20 as looking down on the superabrasive layer 23. There are four teeth 21 and five troughs 22 around the outer circumference of the cutter 20. As seen in FIG. 6, which is a side view of a cutter, the teeth 21 and troughs 22 may extend the entire length of the height of the cutter 20.

During cutting with the superabrasive cutting elements, one, two, or more of the cutting points or edges may engage the material to be cut, such as rock. In one embodiment of the cutting element, the layer has three teeth, and is oriented during cutting such that the first tooth engages the rock initially and the two flanking teeth engage the rock as the cutter wears in. In another embodiment, a superabrasive cutter has four teeth and is oriented such that the two central teeth engage the rock initially. In another embodiment, the contact is such that the center of a trough contacts the material to be cut, wherein the two cutting points on either side of the trough engage the material. In another embodiment, a single tooth may engage the material.

In another embodiment, the cutting element may be rotated such that the cutting points on the other side may be used, once the cutting points on the first side of the cutting element are worn. Teeth may be formed on two or more locations around the circumference of the superabrasive table, so that cutters may be de-brazed after drilling and re-used with fresh cutting edges.

Cutting elements comprising one or more troughs in the abrasive layer exhibit increased lifetime as compared to traditional cylindrical superabrasive cutters. In the cutting elements, one or more advantages may be, but are not limited to: (1) lower force per cutting point at the same weight on bit (WOB), (2) lower friction and lower temperatures during cutting due to reduced drag due to non-cutting surfaces, (3) increased depth of cut leading to higher rates of penetration, (4) increased bit stability due to the cutters running within multiple grooves formed during the drilling process, (5) localization of impact damage to a single tooth on a cutter, allowing surviving teeth to continue drilling through, (6) changes in the residual and applied stress fields in the cutting point, and (7) more efficient removal of cuttings from the cutter face through channels formed between cutting teeth.

EXAMPLE

Laboratory tests of cutter performance were conducted on a horizontal end mill, which made an interrupted cut on a 16 inch long×10 inch tall red granite block. The traverse speed across the block was about 2.5 inches/min. and the depth of cut was about 0.15 inches. One pass of the block was equivalent to approximately about 2080 individual impacts on the cutter. This test simultaneously evaluates impact performance and abrasion resistance, or in other words, overall cutter performance. A test was conducted on two cutters: one cutter being a 19 mm diameter superabrasive cutter and the other cutter which is a 19 mm diameter superabrasive cutter having five teeth that are about 0.07 inches high by about 0.05 inches wide at a spacing of about 0.1 inches were machined by using EDM to cut troughs into the outer circumference of the cutter. The toothed cutter was oriented so that the two central teeth both engaged the rock. The results of the test showed a 40% improvement in cutter life of the toothed cutter (22,173 vs. 15,725 impacts or 10.66 vs. 7.56 passes across the rock face).

It should be noted that many benefits expected from the embodiments depend on the incorporation of the multiple-cutting points cutter in a drill bit, and will be highly dependent on the suitability of the bit design and construction. But, these results indicate intrinsic improvements in cutter lifetime due solely to the multiple cutting edges. Therefore, the cutting elements described herein may be incorporated into various bit designs.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art that are also intended to be encompassed by the following claims.

What is claimed is:

1. A cutting element comprising:

a layer of integrally bonded superabrasive particles, wherein the layer has an outer circumference comprising at least one trough, the trough comprising a distinct cutting point on either side; and a substrate, wherein the layer is disposed over the substrate that is substantially cylindrical in shape, the substrate having an outer circumference, wherein at least one trough is formed into the outer circumference of the substrate.

2. The cutting element of claim 1, wherein the superabrasive particles comprise diamond or cubic boron nitride.

3. The cutting element of claim 1, wherein the substrate comprises a metal carbide.

4. The cutting element of claim 1, wherein the substrate comprises a Group IVB, Group VB, or Group VIB metal carbide.

5. The cutting element of claim 1, wherein the layer has two or more troughs, the two or more troughs comprising a tooth having a distinct cutting edge between the troughs.

6. The cutting element of claim 5, wherein the cutter comprises a plurality of teeth.

7. The cutting element of claim 1, wherein the layer has a top substantially planar surface.

8. The cutting element of claim 1, wherein the cutting element is incorporated into a drag bit for use in cutting material.

9. A rock drilling drag bit comprising:

a cutting element having a layer of integrally bonded superabrasive particles, wherein the layer has a substantially planar surface and an outer circumference comprising at least one trough, the trough comprising a distinct cutting point on either side; and a substrate that is substantially cylindrical in shape, the substrate having an outer circumference, wherein at least one trough is formed into the outer circumference of the substrate, wherein the layer is disposed over the substrate.

10. The rock drilling drag bit of claim 9, wherein the superabrasive particles comprise diamond or cubic boron nitride.

11. The rock drilling drag bit of claim 9, wherein the substrate comprises a metal carbide.

12. The rock drilling drag bit of claim 9, wherein the layer has two or more troughs, the two or more troughs comprising a tooth having a distinct cutting edge between the troughs.

13. The rock drilling drag bit of claim 9, wherein the cutter comprises a plurality of teeth.

14. A method of cutting a material comprising: providing a cutting element comprising a layer of integrally bonded superabrasive particles having a trough comprising a distinct cutting point on either side disposed over a substrate that is substantially cylindrical in shape, the substrate having an outer circumference, wherein at least one trough is formed into the outer circumference of the substrate;

initially contacting the cutting element to a surface of the material; and dragging the cutting element along the surface of the material to perform cutting.

15. The method of claim 14, wherein the cutting element contacts the material at a center of the trough, wherein the initial contact between the cutting element and the material occurs at two points on either side of the trough.

16. The method of claim 14, wherein the cutting element comprises two or more troughs, the two or more troughs comprising a tooth having a distinct cutting edge between the troughs, wherein the cutting element contacts the material at the center of a tooth.

17. The method of claim 14, wherein:

the cutting element has a plurality of cutting points;

the cutting element initially contacts the material with a first one or more of the cutting points; and additional cutting points contact the material after the first cutting points have undergone abrasive wear.

18. A cutting element comprising:

a layer of integrally bonded superabrasive particles, the layer having an outer circumference comprising at least one trough, the trough comprising a distinct cutting point on either side and comprising a non-zero angle relative to a central axis of the cutting element; and a substrate, wherein the layer is disposed over the substrate that is substantially cylindrical in shape, the substrate having an outer circumference, wherein at least one trough is formed into the outer circumference of the substrate.

* * * * *